US005721532A

United States Patent [19]

Lehmann et al.

[11] Patent Number: 5,721,532

[45] Date of Patent: Feb. 24, 1998

[54] MOTION SENSITIVE REMINDER

[76] Inventors: Roger W. Lehmann, 808 Ashley Ave., Brielle, N.J. 08730; Michael I. Satten, 26 Crow La., Kings Point, N.Y. 11024

[21] Appl. No.: 764,823

[22] Filed: Dec. 12, 1996

[51] Int. Cl.[6] ..... G08B 13/14

[52] U.S. Cl. ..... 340/571; 340/568; 340/309.15; 340/527; 340/523; 340/540

[58] Field of Search ..... 340/568, 571, 340/573, 540, 686, 687, 689, 566, 523, 529, 530, 527, 309.15, 526, 691, 692, 693; 368/109, 1, 10

[56] References Cited

U.S. PATENT DOCUMENTS

| | | | |
|---|---|---|---|
| 3,436,726 | 4/1969 | Dentz | 340/457 |
| 3,870,818 | 3/1975 | Barton et al. | 395/2.67 |
| 4,016,538 | 4/1977 | Miller | 340/457 |
| 4,051,397 | 9/1977 | Taylor | 310/329 |
| 4,229,663 | 10/1980 | Sibley | 307/9.1 |
| 4,291,301 | 9/1981 | Chan | 340/568 |
| 4,412,205 | 10/1983 | Von Kemenczky | 340/331 |
| 4,558,307 | 12/1985 | Lienart van Lidt de Jeude | 340/527 |
| 4,884,067 | 11/1989 | Nordholm | 340/686 |
| 4,933,852 | 6/1990 | Lemelson | 364/424.035 |
| 4,980,667 | 12/1990 | Ames | 340/427 |
| 5,043,705 | 8/1991 | Rooz et al. | 340/573 |
| 5,045,839 | 9/1991 | Ellis et al. | 340/539 |
| 5,294,914 | 3/1994 | Dallas | 340/432 |
| 5,315,289 | 5/1994 | Fuller et al. | 340/532 |
| 5,316,515 | 5/1994 | Hyman et al. | 446/28 |
| 5,640,145 | 6/1997 | Newham | 340/573 |

*Primary Examiner*—Jeffery Hofsass
*Assistant Examiner*—Benjamin C. Lee
*Attorney, Agent, or Firm*—Caesar, Rivise, Bernstein, Cohen & Pokotilow, Ltd.

[57] ABSTRACT

A compact motion sensitive reminder device that is readily attachable to almost any movable item that emits an audio signal when the item is initially moved from a stationary condition and then remains silent during the item's use, and emits the audio signal again only after a certain amount of time that the movable item has remained stationary.

26 Claims, 4 Drawing Sheets

MOTION SENSITIVE REMINDER

FIELD OF THE INVENTION

The invention relates generally to automatic advisory devices and more specifically to automatic audible devices that are attachable to items that can be moved such as apparel, sports equipment, luggage, or any movable components on a stationary device, etc. for reminding the user to take appropriate action upon initial movement of the item.

BACKGROUND OF THE INVENTION

The following U.S. Patents disclose motion detection alerting devices, such as those used on vehicles, bicycles and children's toys.

U.S. Pat. No. 4,980,667 (Ames) discloses a bicycle alarm device for audibly warning the bicycle owner that his/her bicycle is being moved impermissibly.

U.S. Pat. No. 5,294,914 (Dallas) discloses a bicycle helmet warning system to alert the seated rider that the helmet stowed in a helmet holder of the bicycle is not being worn.

U.S. Pat. No. 4,016,538 (Miller) discloses a safety device for a motorcycle which includes a device that actuates the horn of a motorcycle if the side stand is down, the ignition is on, and the motorcycle is in the driving position.

In U.S. Pat. No. 5,316,515 (Hyman et al.) discloses a child's toy that is worn by the child and includes, among other things, a motion switch for detecting movements of the toy and for generating sounds responsive to the movements.

In U.S. Pat. No. 4,051,397 (Taylor) discloses a two-sensitivity level kinetic sensor that activates an alarm circuit whenever the surface, upon which the sensor is disposed, is moved. In U.S. Pat. No. 4,229,663 (Sibley) discloses a device for sensing vehicular mechanical motion.

In U.S. Pat. No. 4,412,205 (Von Kemenczky) discloses a switch device for use on an illuminated article worn by a user that illuminates when certain motions are made by the wearer.

U.S. Pat. No. 5,315,289 (Fuller et al.) discloses an interactive protective system that includes a protective garment worn by the operator and includes sensors which detect respective conditions for alerting the operator about nearby dangers.

U.S. Pat. Nos. 3,870,818 (Barton et al.) and 4,933,852 (Lemelson) disclose apparatus for indicating operational characteristics of a machine, such as a motor vehicle, that utilizes among other things synthetic speech to advise the operator of appropriate action to be taken.

In U.S. Pat. No. 3,436,726 (Dentz) discloses a hood actuated warning device for motor vehicles that warns the operator in the event that the hood of the vehicle is not fully closed at such times when the vehicle is being operated.

However, there remains a need for a compact device that is readily attachable to almost any movable item that provides an advisory statement to the person who initially moves the item and then remains silent during the item's use, and emits the advisory statement again only after a certain amount of time that the item remains stationary.

OBJECTS OF THE INVENTION

Accordingly, it is the general object of this invention to provide an apparatus which improves upon and overcomes the disadvantages of the prior art.

It is another object of this invention to provide a motion sensitive reminder device that is small in size.

It is still another object of this invention to provide a motion sensitive reminder device that is attachable to any movable item.

It is still yet another object of this invention to provide a motion sensitive reminder device that minimizes power consumption.

It is even a further object of this invention to provide a motion sensitive reminder device that can emit an audio signal, such as an audible instruction, a sound, or music without becoming a nuisance.

It is still yet a further object of this invention to provide a motion sensitive reminder device that automatically resets itself under predetermined conditions.

It is still yet another object of this invention to provide a motion sensitive reminder device that indicates to the user when power is low.

SUMMARY OF THE INVENTION

These and other objects of the instant invention are achieved by providing a motion sensitive reminder apparatus that is adaptable for coupling to any item that is movable. The motion sensitive reminder comprises a housing and means for releasably coupling the housing to the movable item. The housing comprises a speaker for emitting an audio signal (e.g., at least one audible statement, music, beeping or any other type of sound), a motion sensor for detecting movement of the movable item, and electronic control means. The electronic control means is electrically coupled to the speaker and to the motion sensor and controls the speaker emission. The electronic control means activates the speaker to emit the audio signal for a predetermined period of time whenever the movable item is initially moved and thereafter silences the speaker during further motion of the movable item. The electronic control means resets the speaker to prepare to emit the audio signal again whenever the movable item has remained stationary for a certain amount of time.

DESCRIPTION OF THE DRAWINGS

Other objects and many of the attendant advantages of this invention will be readily appreciated as the same becomes better understood by reference to the following detailed description when considered in connection with the accompanying drawings wherein.

DETAILED DESCRIPTION OF THE PREFERRED EMBODIMENT

Figure 1:
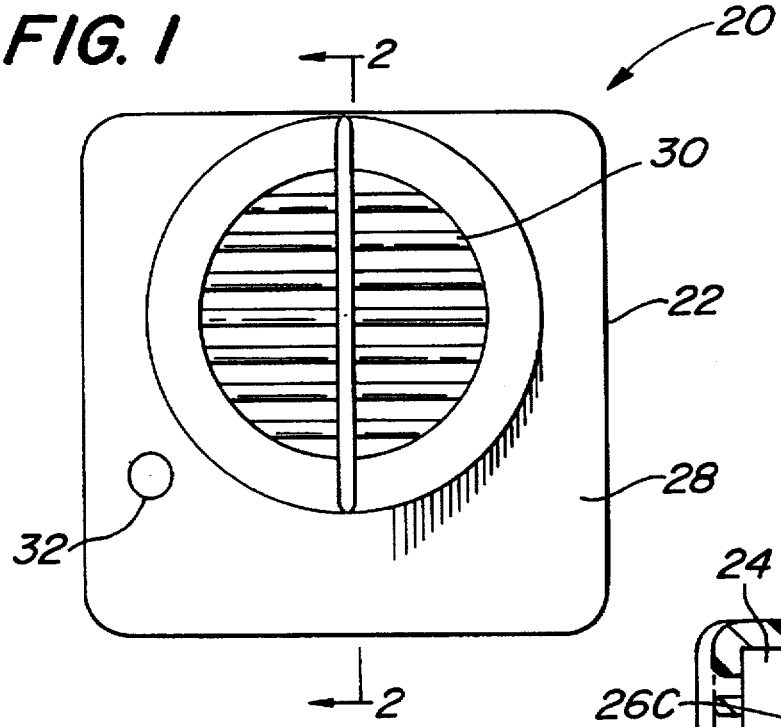
FIG. 1 is an enlarged front view of the present invention.
Figure 4:
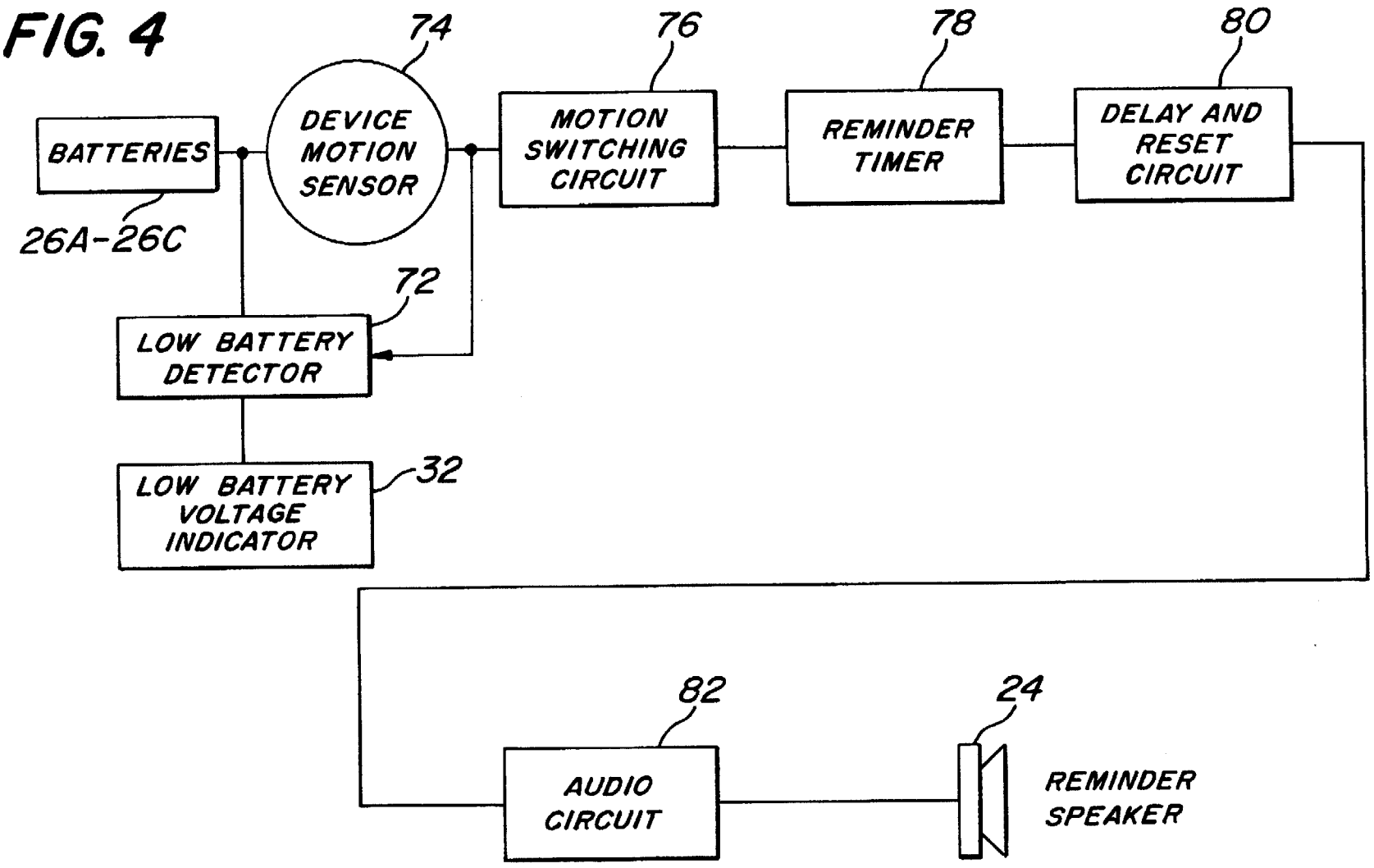
FIG. 4 is a block diagram of the electronics of the present invention.

Referring now in detail to the various figures of the drawing wherein like reference characters refer to like parts, there is shown at 20 in FIG. 1, a motion sensitive reminder (hereinafter "MSR"). The MSR 20 is a compact unit that comprises a housing 22 for supporting a speaker 24, three button battery cells 26A–26C (FIG. 6) and a PCB board (not shown) for supporting the electronics (FIG. 4). One of the features of the MSR 20 is the small size of the housing 22 (e.g., approximately 1.5"×1.5") which makes it readily attachable to almost any item that is movable. Moreover, various attachment means can be used to couple the MSR 20 to these items; two exemplary coupling means are discussed in detail below.

The front side 28 of the housing 22 comprises a protective grill 30 behind which the speaker 24 is located. A low battery voltage indicator 32 is also positioned on the front side 28.

Figure 2:
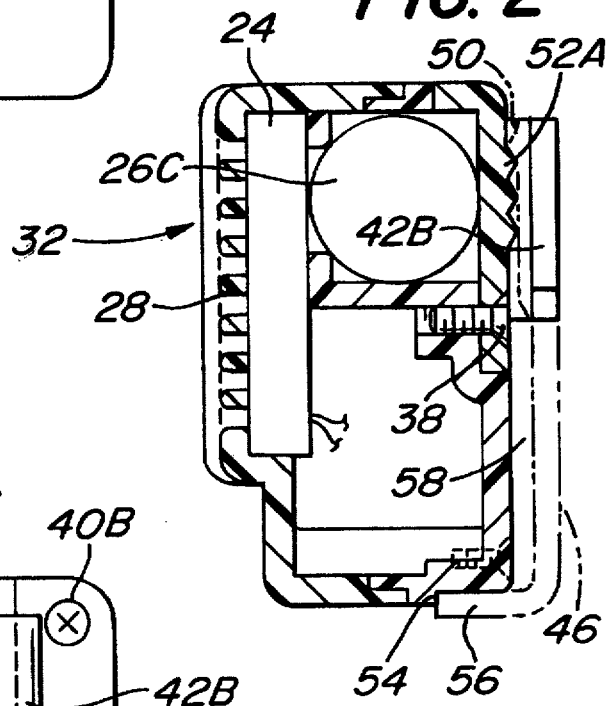
FIG. 2 is an enlarged sectional view taken along line 2—2 of FIG. 1.
Figure 3:
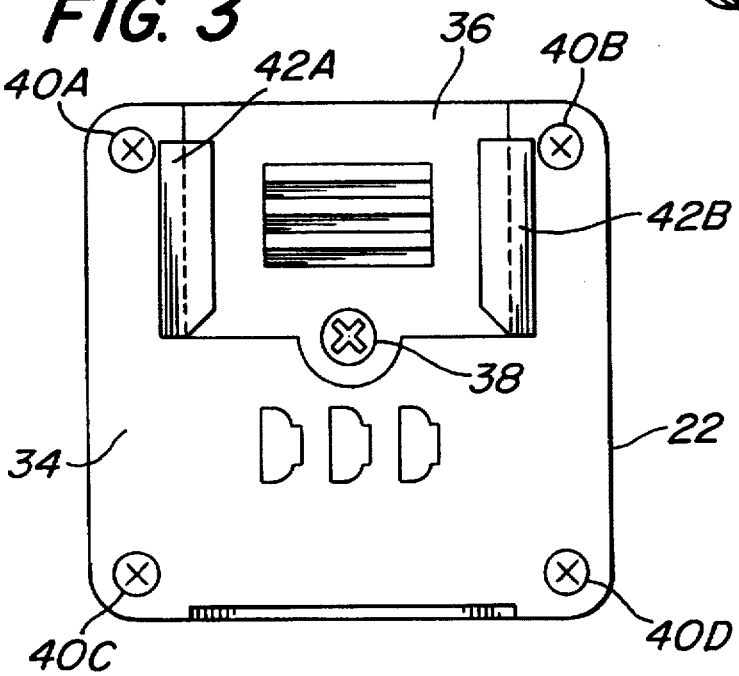
FIG. 3 is an enlarged back view of the present invention.
Figure 6:
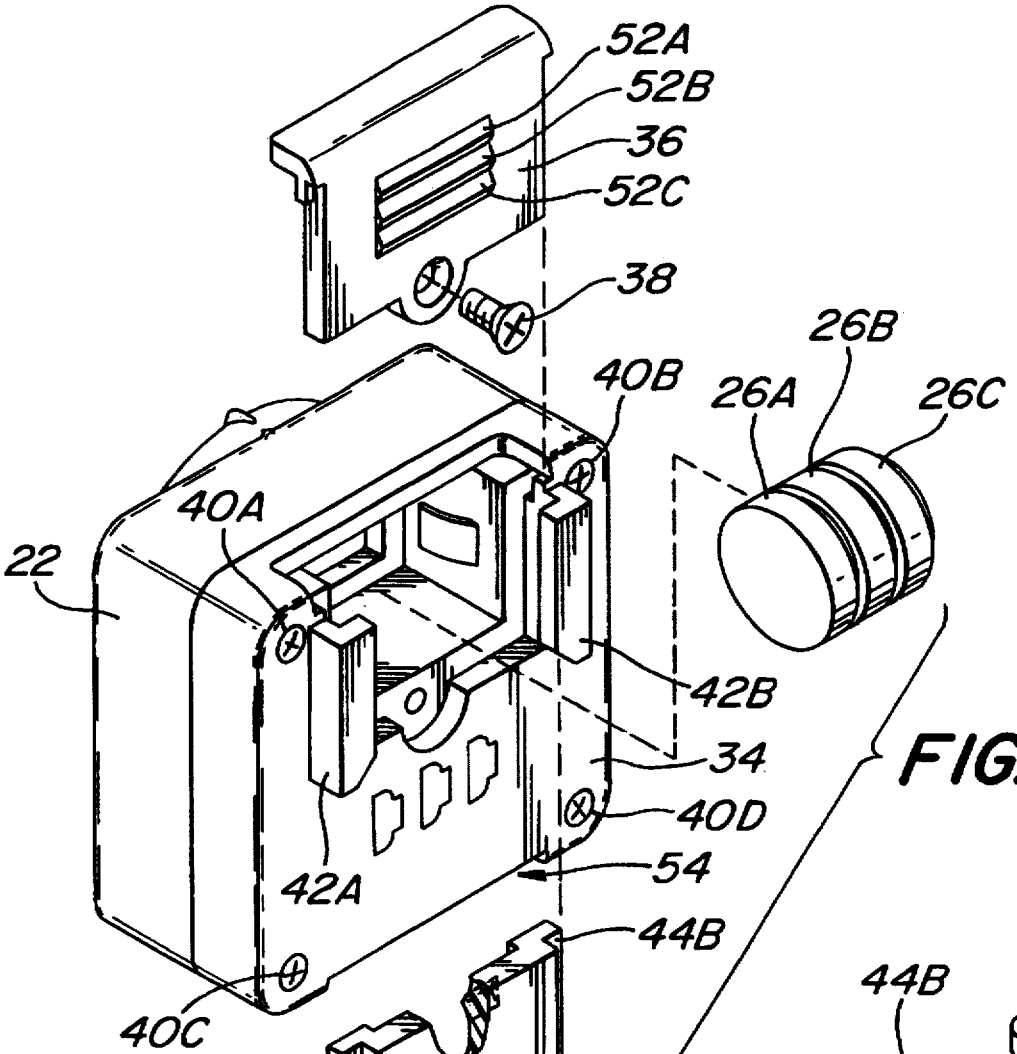
FIG. 6 is an exploded view showing the present invention utilizing an attachment means.
Figure 7:
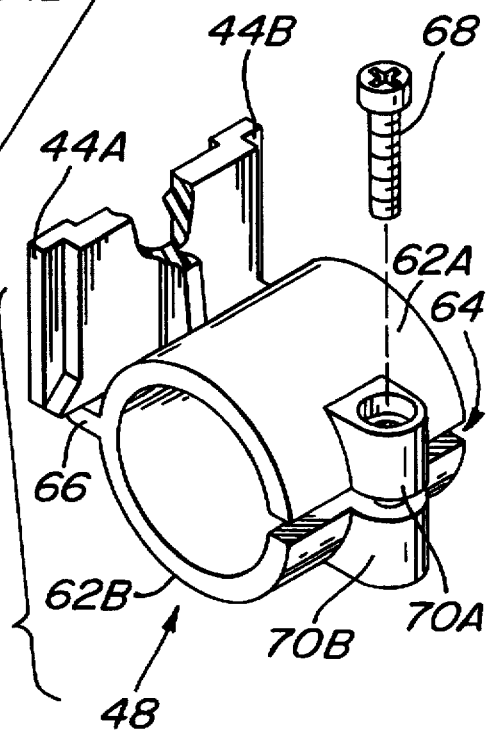
FIG. 7 is an exploded view showing the present invention utilizing an alternative attachment means.

The back side 34 of the housing 22 comprises a battery compartment door 36 that is releasably secured to the housing 22 via a screw 38. The back side 34 itself is releasably secured to the housing 22 via four screws 40A–40D. A pair of L-shaped sleeves 42A and 42B are disposed on each side of the battery compartment. As shown most clearly in FIG. 6, these L-shaped sleeves 42A and 42B are adapted to receive corresponding L-shaped rails 44A and 44B of a clasp 46 (FIG. 6) or a bar attachment 48 (FIG. 7). These L-shaped rails 44A/44B form a frictional fit inside the L-shaped rails 42A and 42B, thus allowing the user to manually engage or disengage the clasp 46 or the bar attachment 48. In addition, as shown most clearly in FIG. 2, the upper portion of the clasp 46 comprises a protruding surface 50, triangular in cross-section, that interfaces with a similar protruding surface 52A, also triangular in cross-section, located on the battery compartment door 36. Two other protruding surfaces 52B and 52C are also available on the battery compartment door 36. The interface of the surfaces 50 and 52A provide a further releasable securement of the housing 22 to the clasp 46. A recess 54 is provided in the lower portion of the back side 34 to properly seat the L-shaped portion 56 of the clasp 46 in the back side 34.

When the clasp 46 is releasably secured to the housing 22, a number of attachment means are available to the user. For example, as shown most clearly in FIG. 2, a ring 58 is provided between the clasp 46 and the back side 34 through which a shoelace, a belt, an extension, etc. can be fed, thereby securing the MSR 20 to a shoe, a person, a skateboard, a scooter, etc. Furthermore, as shown in FIG. 6, two holes 60A and 60B are provided in the clasp 46 through which a fastener (e.g., a screw), a shoelace, a cord, etc. can be fed. Thus, an unlimited number of attachment means are available.

For example, using this coupling means, the MSR 20 can be coupled to a power tool (e.g., a power saw) with the audible statement "Put Your Goggles On" pre-programmed into the electronics (to be discussed later) so that when the power tool is moved, the statement "Put Your Goggles On" is emitted as soon as the power tool is initially moved.

As shown in FIG. 7, a bar attachment 48 is also available for such things as a bicycle, motorcycle, or any other mobile apparatus having a bar. As stated earlier, the bar attachment 48 comprises L-shaped rails 44A and 44B that are releasably secured within the L-shaped sleeves 42A and 42B. The bar attachment 48 also includes two semi-circular portions 62A and 62B that are separable on one side 64 while having a common attachment portion 66 that attaches the semi-circular portions 62A/62B to the L-shaped rails 44A and 44B. As is readily apparent, the separable side 64 permits the semi-circular portions 62A and 62B to be spread and then slipped over a bar. A screw 68 is then tightened down into aligned sleeves 70A and 70B for releasably securing the bar attachment 48 to the bar of the desired bicycle, motorcycle, etc.

As shown in the block diagram of FIG. 4, the electronics of the MSR 20 comprises the batteries 26A–26C, a low battery detector 72, the low battery voltage indicator 32, a device motion sensor 74, a motion switching circuit 76, a reminder timer circuit 78, a delay and reset circuit 80, an audio circuit 82 and the speaker 24.

Figure 5:
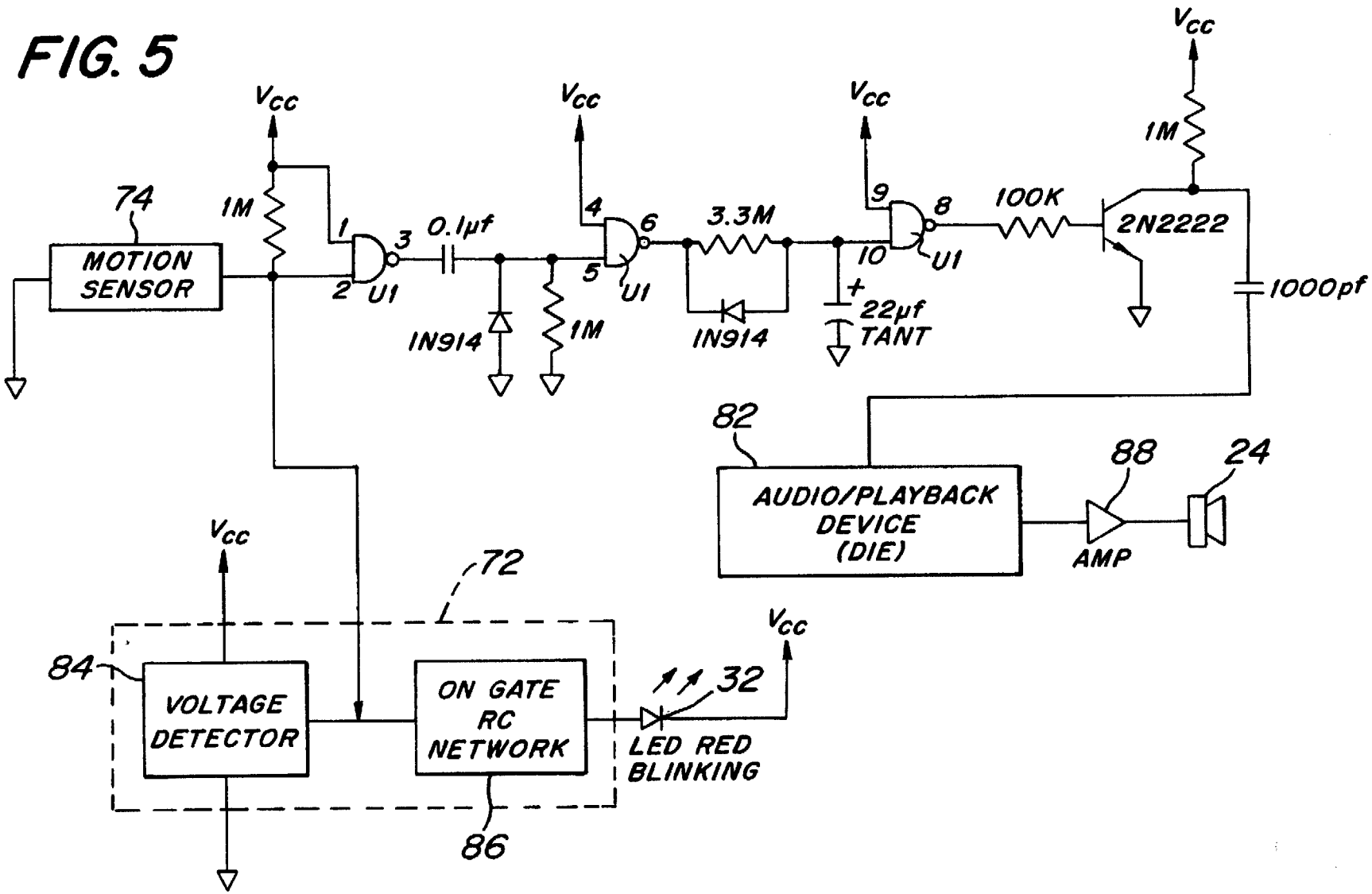
FIG. 5 is a circuit schematic of the electronics of the present invention.

As shown in FIG. 5, the low battery detector 72 comprises a voltage detector 84 (e.g., Seiko S-80751SN solid state device) rated at 15% below $V_{cc}$. In addition, the low battery detector 72 comprises an on-gate/RC network 86 that is coupled to the low battery voltage indicator 32. When the voltage detector 84 detects the low battery voltage, the detector 84 drives the on-gate/RC network 86 which effectively couples the indicator 32 (e.g., a red LED, Newark Electronics 637-040 Size T1, 3 mm diameter, low current) to ground through the voltage detector 84, thereby providing a current path from $V_{cc}$ through the indicator 32 and to ground. The RC network (not shown) is gated ON by the motion sensor 74. When the motion sensor 74 is not in motion, the indicator 32 does not flash, thereby conserving battery power during a low battery condition (e.g., when the item to which the MSR 20 is attached is stowed in a garage for a long period of time where no one would see the low battery indication). Furthermore, the RC network causes the indicator 32 to flash when activated in order to lower the duty cycle, thereby conserving additional power than would a continuously ON indicator.

The device motion sensor 74 may be a Durakool 4929 or equivalent motion sensor that can operate in a normally-open condition or in a normally-closed condition.

The motion switching circuit 76, reminder timer circuit 78, on-delay circuit 80 and the delay/reset circuit 82 all use conventional resistive, capacitive and diode components, including nand gates available on a Toshiba TC4093BP (U1) or equivalent. In particular, as shown in FIG. 5, the motion switching circuit 76 comprises nand gates G1 and G2. The reminder timer circuit 78 comprises the diode D and the 22 μF capacitor network for keeping the 22 μF capacitor discharged during MSR 20 motion. The delay and reset circuit 80 comprises the 3.3 MΩ resistor and the 22 μF capacitor network and the nand gate G3.

The audio circuit 82 can be an ISD2560S single chip voice record/playback device. This CMOS device includes an on-chip oscillator, microphone pre-amplifier, automatic gain control, anti-aliasing filter, smoothing filter, a speaker amplifier and a timer. Recordings are stored in nonvolatile memory cells, providing zero power message storage. Both voice and audio signals are stored directly, in their natural analog form, into EEPROM memory. Direct analog storage allows voice reproduction.

Alternatively, the audio circuit 82 can be any other audio playback device, digital (e.g., Quik Voice Devices VP1000 manufactured by Eletech Electronics, Inc.) or analog, having similar on-board functions described above with respect to the ISD2560S. Furthermore, the audio signal actually played out can include voice, music, beeping or any other type of sound that may comprise an audio signal.

The amplifier 88 permits the speaker 24 to provide a higher volume output and is optional.

The speaker 24 is a 1", 8Ω speaker.

It should be understood that the use of discrete components, such as the Seiko voltage detector and the IDS2560S voice chip, requires 6 VDC (i.e., four conventional button-type watch batteries, each 1.5 VDC) for $V_{cc}$. Where a single die is used which integrates most of the components of FIG. 5 (except for the batteries 26A–26C, the motion sensor 74, the indicator 32 and the speaker 32) into a single chip, the required power level can be reduced to 4.5 VDC for $V_{cc}$. Other than that, operation of the electronics on the single die is identical to the electronics shown in FIG. 5. Thus, as depicted in FIG. 6, three conventional button-type watch batteries 26A–26C (1.5 VDC each) are shown, for providing the $V_{cc}$ to the single die electronics.

Operation of the electronics will now be discussed.

As long as the MSR 20 is in motion, the output of the motion sensor 74 is constantly changing from an open to a closed condition. Therefore the output of G1 is a square wave, as well as the output of G2. When the output of G2 is a logic "1", the 22 μF capacitor is charged through the 3.3 MΩ resistor at a time constant of approximately 72.6 seconds. When the output of G2 is a logic "0", the 22 μF capacitor is discharged through the forward conducting diode D that exhibits an approximate 30 Ω impedance. The discharge time constant is approximately 0.66 msec. Hence, the 22 μF capacitor discharges approximately 100,000 times faster than it charges. Once the 22 μF capacitor has discharged, the output of G3 goes to a logic "1", thereby forward biasing the NPN transistor Q and turning the transistor Q on. Turning on transistor Q causes the voltage $V_T$ to drop to ground, thus triggering the audio circuit 82 which outputs a predetermined audio signal such as audible statements, e.g., "Put Your Helmet On, Put Your Elbow Pads On, Put Your Knee Pads On"; or sounds such as music beeping, sirens, etc., that have been previously stored in the audible circuit 82. Once triggered, the timer within the audio circuit 82 causes this audio signal to be played out for approximately 6 seconds.

As long as the MSR 20 is in motion, the 22 μF capacitor continues to be discharged and the transistor Q remains on with $V_T$ at ground. However, since the audio circuit 82 is only triggered by the drop of $V_T$ from high to ground, the audio circuit 82 remains off.

Once the MSR 20 is stationary, the input to G2 goes to a steady logic "0", the output of G2 goes to a steady logic "1" and the 22 μF capacitor begins to slowly charge up for the 72.6 seconds. After the 22 μF capacitor is charged, the output of G3 goes to a steady logic "0" and the audio circuit 82 is reset awaiting another initial motion detection.

It is thus within the broadest scope of this invention to include any type of analog or digital audio circuit 82 for providing an audio signal including voice, music or any other type of sound that can be heard.

Without further elaboration, the foregoing will so fully illustrate our invention that others may, by applying current or future knowledge, readily adopt the same for use under various conditions of service.

We claim:

1. An motion sensitive reminder apparatus being adaptable for coupling to any item that is movable, said motion sensitive reminder comprising:

a housing;

means for releasably coupling said housing to the movable item;

said housing comprising:

a speaker for emitting an audio signal;

a motion sensor for detecting movement of the movable item;

electronic control means, electrically coupled to said speaker and to said motion sensor, for controlling said speaker emission, said electronic control means activating said speaker to emit said audio signal for a predetermined period of time whenever the movable item is initially moved and thereafter silencing said speaker during further motion of the movable item and resetting said speaker to prepare to emit said audio signal again whenever the movable item has remained stationary for a certain amount of time.

2. The apparatus of claim 1 wherein said predetermined period is approximately 6 seconds.

3. The apparatus of claim 1 wherein said certain amount of time is approximately 1 minute.

4. The apparatus of claim 1 wherein said audio signal comprises at least one audible statement.

5. The apparatus of claim 1 wherein said audio signal comprises a sound.

6. The apparatus of claim 1 wherein said audio signal comprises music.

7. The apparatus of claim 1 wherein said means for releasably coupling said housing comprises a pair of vertically-oriented L-shaped sleeves disposed on said housing and a clasp, said L-shaped sleeves being adaptable to receive said clasp, said clasp attachable to the movable item.

8. The apparatus of claim 1 wherein said means for releasably coupling said housing comprises a pair of vertically-oriented L-shaped sleeves disposed on said housing and a bar attachment, said L-shaped sleeves being adaptable to receive a portion of said bar attachment, said bar attachment comprising separable semi-circular portions for coupling to a bar.

9. The apparatus of claim 1 wherein said electronic control means resides on a single die.

10. The apparatus of claim 9 wherein said electronic control means comprises an audio circuit for providing an electrical signal representative of said audio signal to said speaker, said motion sensor being coupled to said audio circuit through a motion switching circuit that is coupled to said motion sensor.

11. The apparatus of claim 10 wherein said audio circuit comprises a timer for terminating said electrical signal representative of said audio signal after said predetermined period of time.

12. The apparatus of claim 10 wherein said electronic control means further comprises a reset means, coupled between said motion switching circuit and said audio circuit, for resetting the electronic control means whenever said apparatus remains stationary for said certain amount of time.

13. The apparatus of claim 12 wherein said motion switching circuit generates an alternating wave whenever said apparatus is in motion.

14. The apparatus of claim 10 wherein said audio circuit is digital.

15. The apparatus of claim 9 wherein said apparatus further comprises batteries and said electronic control means further comprises a low battery voltage detector coupled to the batteries, said low battery voltage detector monitoring the voltage of the batteries and activating an indicator whenever the voltage falls to a predetermined value.

16. The apparatus of claim 15 wherein said low battery voltage detector is coupled to said motion sensor, said motion sensor enabling said low battery voltage detector to activate said indicator when said motion sensor is detecting motion.

17. The apparatus of claim 16 wherein said low battery voltage detector causes said indicator to flash to conserve power during a low battery voltage condition.

18. The apparatus of claim 1 wherein said electronic control means comprises an audio circuit for providing an electrical signal representative of said audio signal to said speaker, said motion sensor being coupled to said audio circuit through a motion switching circuit that is coupled to said motion sensor.

19. The apparatus of claim 18 wherein said audio circuit comprises a timer for terminating said electrical signal representative of said audio signal after said predetermined period of time.

20. The apparatus of claim 18 wherein said electronic control means further comprises a reset means, coupled between said motion switching circuit and said audio circuit, for resetting the electronic control means whenever said apparatus remains stationary for said certain amount of time.

21. The apparatus of claim 20 wherein said motion switching circuit generates an alternating wave whenever said apparatus is in motion.

22. The apparatus of claim 21 wherein said reset means comprises a resistor-capacitor-diode network, said resistor and diode being connected in parallel with said capacitor coupled in series with said parallel connected resistor and diode, said diode and capacitor forming a quick discharge path for discharging said capacitor whenever said apparatus is in motion, and said resistor causing said capacitor to charge for said certain amount of time whenever said apparatus is stationary for said certain amount of time, thereby resetting said speaker to prepare to emit again said audio signal.

23. The apparatus of claim 18 wherein said apparatus further comprises batteries and said electronic control means further comprises a low battery voltage detector coupled to the batteries, said low battery voltage detector monitoring the voltage of the batteries and activating an indicator whenever the voltage falls to a predetermined value.

24. The apparatus of claim 23 wherein said low battery voltage detector is coupled to said motion sensor, said motion sensor enabling said low battery voltage detector to activate said indicator when said motion sensor is detecting motion.

25. The apparatus of claim 24 wherein said low battery voltage detector causes said indicator to flash to conserve power during a low battery voltage condition.

26. The apparatus of claim 18 wherein said audio circuit is digital.

* * * * *